United States Patent [19]

Nestoridis

[11] 4,002,463

[45] Jan. 11, 1977

[54] UPGRADING THE NICKEL CONTENT FROM LOW GRADE NICKEL LATERITIC IRON ORES

[75] Inventor: Antonios Nestoridis, Athens, Greece

[73] Assignee: Financial Mining - Industrial and Shipping Corporation, Athens, Greece

[22] Filed: Mar. 25, 1976

[21] Appl. No.: 670,224

[30] Foreign Application Priority Data

Apr. 4, 1975 Greece ..... 6410

[52] U.S. Cl. ..... 75/1 R; 75/3; 423/138; 423/493

[51] Int. Cl.[2] ..... C22B 1/08

[58] Field of Search ..... 75/1 R, 1 T, 2, 3, 4, 75/5, 82; 423/138, 493

[56] References Cited

UNITED STATES PATENTS

| | | | |
|---|---|---|---|
| 3,656,935 | 4/1972 | Iwaski | 75/82 |
| 3,701,647 | 10/1972 | Yasui et al. | 75/82 |
| 3,725,039 | 4/1973 | Jepsen | 75/82 |
| 3,754,896 | 8/1973 | Iwaski | 75/82 |
| 3,801,306 | 4/1974 | Rey et al. | 75/82 |
| 3,841,864 | 10/1974 | Rey et al. | 75/82 |
| 3,856,505 | 12/1974 | Ogawa et al. | 75/82 |
| 3,876,415 | 4/1975 | Bell et al. | 75/82 |
| 3,914,124 | 10/1975 | O'Neill et al. | 75/82 |

FOREIGN PATENTS OR APPLICATIONS

| | | | |
|---|---|---|---|
| 848,377 | 8/1970 | Canada | 75/2 |
| 42-15464 | 8/1967 | Japan | 75/2 |
| 45-7414 | 3/1970 | Japan | 75/2 |
| 1,064,469 | 4/1967 | United Kingdom | 75/82 |

*Primary Examiner*—L. Dewayne Rutledge
*Assistant Examiner*—Michael L. Lewis
*Attorney, Agent, or Firm*—Watson, Cole, Grindle & Watson

[57] ABSTRACT

The nickel content from low grade nickel lateritic iron ore is upgraded by a combined process of segregation and magnetic separation or flotation. Ground ore is thoroughly mixed with a small quantity of calcium carbonate, calcium sulfate and coke and is sprayed with a solution of sodium chloride to make appropriate pellets. These pellets are gradually heated under a neutral or a slightly reducing atmosphere to a temperature of 1050° C maximum for up to 90 minutes. Roasting at this temperature is carried out for a predetermined period of time so as to convert all the nickel from the ore to a metallic condition. The roasted material is cooled, ground in a water medium and finally subjected to a wet or dry magnetic separation or flotation separation treatment so as to obtain a rich nickel concentrate.

The process may be carried without forming pellets merely by thoroughly mixing the ground ore with sodium chloride, limestone, gypsum and coke.

9 Claims, 1 Drawing Figure

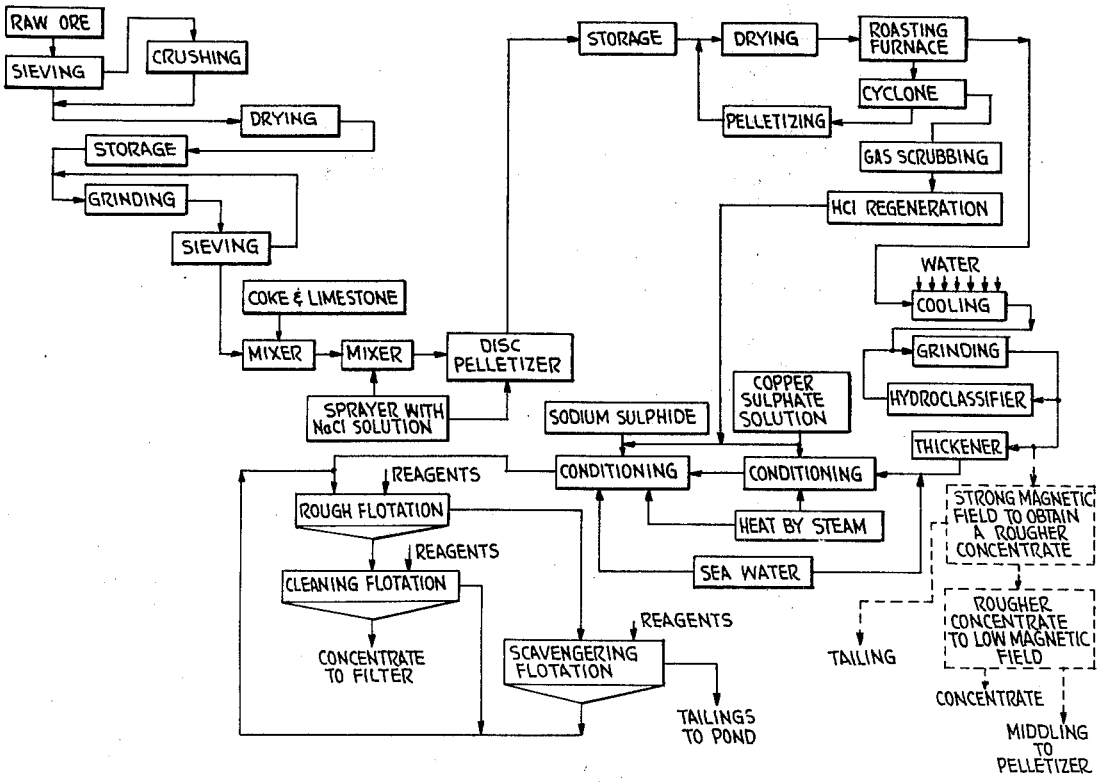

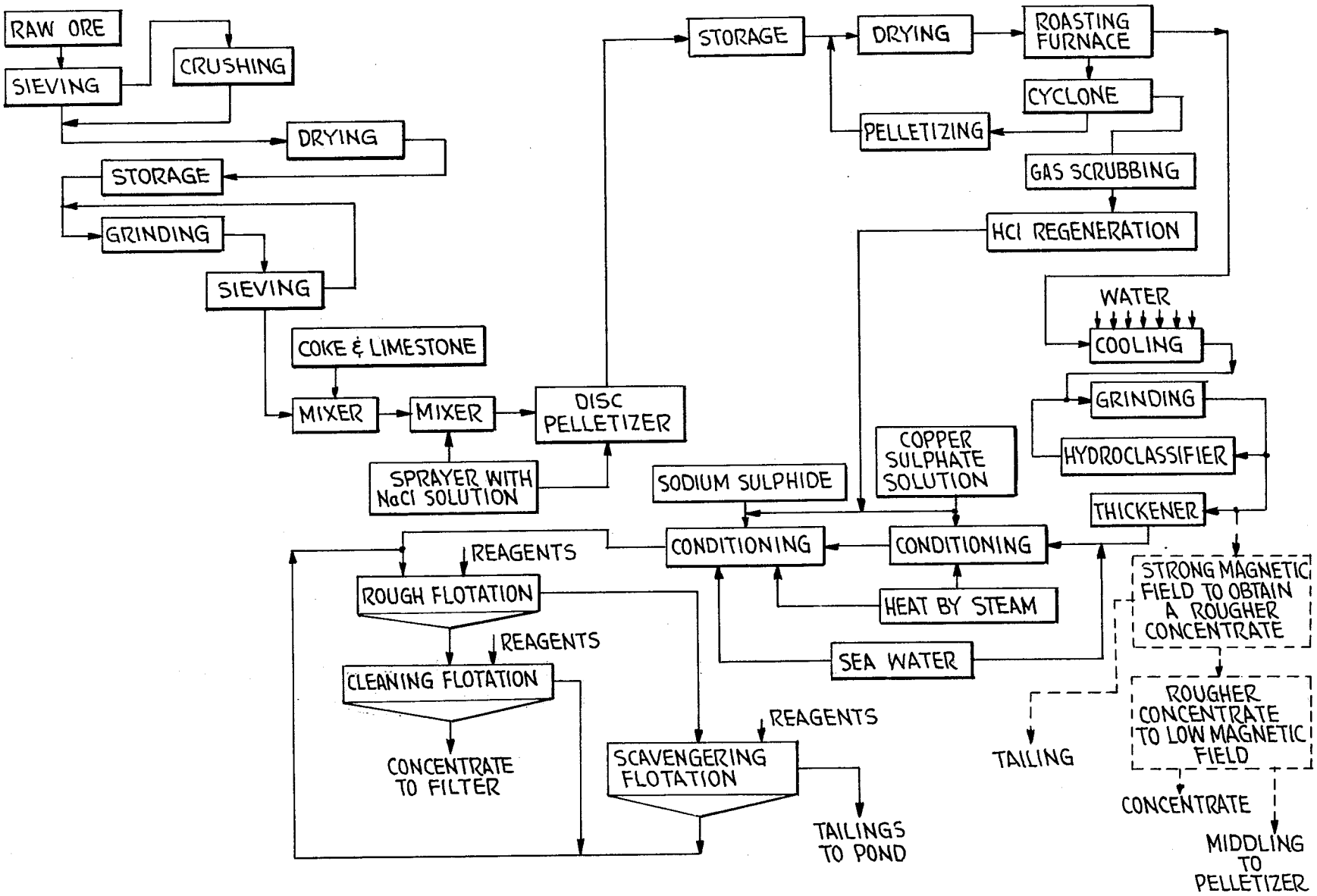
RAW ORE
SIEVING
CRUSHING
DRYING
STORAGE
GRINDING
SIEVING
COKE & LIMESTONE
MIXER
MIXER
SPRAYER WITH NaCl SOLUTION
DISC PELLETIZER
STORAGE
DRYING
PELLETIZING
ROASTING FURNACE
CYCLONE
GAS SCRUBBING
HCl REGENERATION
WATER
COOLING
GRINDING
HYDROCLASSIFIER
THICKENER
STRONG MAGNETIC FIELD TO OBTAIN A ROUGHER CONCENTRATE
ROUGHER CONCENTRATE TO LOW MAGNETIC FIELD
CONCENTRATE
MIDDLING TO PELLETIZER
TAILING
COPPER SULPHATE SOLUTION
CONDITIONING
HEAT BY STEAM
SEA WATER
SODIUM SULPHIDE
CONDITIONING
REAGENTS
ROUGH FLOTATION
REAGENTS
CLEANING FLOTATION
CONCENTRATE TO FILTER
REAGENTS
SCAVENGERING FLOTATION
TAILINGS TO POND

UPGRADING THE NICKEL CONTENT FROM LOW GRADE NICKEL LATERITIC IRON ORES

BACKGROUND OF THE INVENTION

The present invention relates to the recovery of nickel in the form of a concentrate from some classes of low grade nickel (from 0.65 to 1% Ni) lateritic iron ore deposits with a relatively high iron content expressed as $Fe_2O_3$ (between 30 and 45%) and a silica content more than 40% (free silica and a complex of silicates, mainly serpentines) by a combined process of segregation and magnetic separation or flotation.

These ores cannot be economically treated today by any available method, unless they are concentrated prior to a subsequent processing to make them commercially feasible.

SUMMARY OF THE INVENTION

The process according to the invention is directed to the upgrading of nickel content from nickel lateritic iron ore having an iron content by weight of over 10%, silica of over 25%, and a nickel content of at least 0.5%. The ore is ground and the ground ore is thoroughly mixed with a small quantity of calcium carbonate, calcium sulphate and coke and is sprayed with a solution of sodium chloride to make the appropriate pellets. The pellets are gradually heated under a neutral or a slightly reducing atmosphere, to reach 950°–1000° C (1050° C maximum) and are then roasted at this temperature for about 1 hour (90 minutes maximum). During the roasting, the nickel as well as part of the iron and cobalt from their respective oxides, are deposited on a carbon surface of coal under a form of very fine metallic particles through repeated cycles of chloridizations, reductions and hydrogen chloride regenerations. The roasted material is cooled, ground in a water medium and finally subjected to a wet or dry magnetic separation or flotation treatment, to obtain a rich nickel concentrate.

Preferably, the ore must be porous during the roasting, in such a way that the gases have a free access in all the mass of the ore giving the possibility to the involved reactions between solid and gas or simply gas phases to take place simultaneously and the gases to escape evenly from the ore. This role is successfully accomplished by calcium carbonate mainly for feeds in pellet forms. A second functin of $CaCO_3$ is that it acts as a storage of HCL which might have been lost during its formation. Apart from this advantage of the devised process, the addition of small amounts of calcium sulphate, has proved to promote the chloridization of nickel when sodium chloride was used as a chloridizing agent. Sodium chloride apart from its role as a chloridizing agent, acts also as a promoter for hydrogen formation.

Large quantities of water are required in (or for effecting) the process, particularly for the flotation. If soft water is not available in a sufficient amount, sea water has also proved to be suitable.

The iron ore subjected to the present process may be obtained by blending different nickel bearing ores, such as laterites and serpentines, etc., so as to achieve a mixture having the percentages of iron, silica and nickel as mentioned above.

The process may be carried out without forming pellets merely by thoroughly mixing the ground ore with sodium chloride, limestone, gypsum and coke. The amount, by weight, of sodium chloride (which may be cooking salt or unrefined salt) may vary between 1.5 and 7.5%, gypsum from 0.1 to 0.5%, coke from 2 to 5% and limestone from 0 to 10%.

The process for making the appropriate pellets requires special care for improved nickel recoveries. Two steps of mixing are therefore required before pelletizing. Firstly, the ground ore is thoroughly mixed with limestone, gypsum and coke and, secondly, the mixing is continued and is sprayed by about three-fourths the total amount of the sodium chloride solution. The remainder of the solution is left for the pelletizing stage, whereby improved nickel recoveries are achieved.

It should be pointed out that, whenever water is required for the grinding step, pulping adjustments, dilutions, reagent solutions and the magnetic separation, soft water as well as sea water may be used. And, diesel oil may be used as an assisting collector in the flotation of the nickel segregated on the carbon surface of the coal and eventually on the gangue ore for better nickel recoveries.

BRIEF DESCRIPTION OF THE DRAWING

The single FIGURE of the drawing is a flow chart which summarizes the process according to the invention. The dotted lines shown in the FIGURE indicate the magnetic separation aspect of the process.

THE MECHANISM OF THE SEGREGATION PROCESS OF THE INVENTION

A segregation process has been heretofore initially applied to copper oxides using coke and sodium chloride as a chloridizing agent. Over the years, numerous nickel segregation studies have been carried out mainly based on the principle of the copper oxide segregation process. In these studies, sodium choride was replaced by calcium chloride being considered as the most efficient chloridizing agent in the nickel segregation process.

The chemical reactions involved in the segregation process may be summarized as follows:

During the heating stage, the chloride added to the ore, reacts with water vapor to produce hydrochloric acid, while the alkalis and alkali-earth oxides react with the gangue to form complexes of silicates. In its turn, hydrochloric acid reacts with a metal oxide (NiO, FeO, etc.) to produce the respective metal chloride according to the following equation:

$$MeO + 2HCl = MeCl_2 + H_2O, \qquad \text{(eq. 1)},$$

where Me may be: Ni, Fe and Co.

Thermodynamically, because of the positive values obtained for the standard free energy changes at all operating temperatures of each metal oxide with HCl, the chloridization step would proceed only when the partial pressure of water is maintained as low as possible (to avoid hydrolysis) and the metal chloride is removed quickly by a subsequent reduction with hydrogen to metal on the coal surface and regeneration of HCl, according to the following equation:

$$MeCl_2 + H_2 = Me + 2HCl. \qquad \text{(eq. 2)}.$$

While the reduction of $NiCl_2$ to nickel metal proceeds quickly, the reduction of $FeCl_2$ with hydrogen is a slow reaction. Consequently, the process itself gives rise to a better selectivity as far as the grade of the nickel is concerned. The hydrogen is formed by the reaction of water vapor with carbon according to the following equation:

$$C + H_2O = H_2 + CO. \quad \text{(eq. 3).}$$

It is interesting to note, that an excess of hydrogen has an adverse effect on nickel segregation, because it would favor the reduction "in situ" and not through the nickel chloride. On the other hand, the FeO which is chloridized easier than NiO to form $FeCl_2$, has a beneficial effect on the chloridization of NiO (thermodynamically better than HCl), as follows:

$$NiO + FeCl_2 = NiCl_2 + FeO. \quad \text{(eq. 4)}$$

Apart from the thermodynamical aspects of the reactions involved in the segregation process, the mineralogical composition of the ore in connection with the new mineral components which might be formed during the heating and roasting stages by the influence of the added reagents plays an important role. Thus the choice of an adequate mixture of reagents would make the nickle oxide more physically accessible to the HCl or $FeCl_2$ action and consequently would improve the kinetics of chloridization.

First of all, the blended ore with the reagents must be porous during the roasting stage in accordance with the invention. So far, calcium carbonate plays this role, mainly for feeds in pellet form, (as has been observed repeatedly during experiments) since during the gradual heating of the ore, $CaCO_3$ is decomposed and the carbon dioxide tends to escape evenly from the pellets leaving voids behind it, thus it would allow the reactions of gas with solid phase and gases between them to take place more easily during the roasting stage.

It was also observed that additions of small amounts of calcium sulphate up to 0.25% by volume has a beneficial effect on the segregation of nickel, by comparing the results obtained for the concentrate (by flotation) in the absence of it and it was concluded that it acts as a promoter of nickel oxide chloridization which is considered as the weakest and most delicate point of the process. Apart from the beneficial effect of calcium sulphate as a promoter, it improves the consistency of the pellets, avoiding the cracking during the preheating and roasting stages.

The remainder CaO (from $CaCO_3$) during the roasting, acts, probably directly, on the lattice of the ore, with some disruptive capacity actions, forming the correspondence silicates and rendering the nickel oxide more amenable to chloridization, presumably by $FeCl_2$. The presence of a substantial amount of fayalite, as was detected by X-ray diffraction in the roasted products, testifies to the above assumption, since the formation of fayalite is viewed as a continuation of the reaction expressed in equation 4, in which 2 molecules of FeO are constantly removed by a molecule of $SiO_2$ to form fayalite, thus improving the kinetics of the chloridization of nickel oxide to nickel chloride and the reduction of the latter by hydrogen.

APPLICATION OF THE PRESENT PROCESS

All tests were carried out on a bench scale, namely, in a horizontal electric furnace with a temperature controller and the charges were introduced inside to a 5cm diameter tight ceramic tube. Feeds in the form of pellets were preferred instead of fines. The velocity of the different gases flowing in the tube during the heating was not higher than 0.35 cm/sec and for 200 g of sample. Higher velocities were found to be deterring in the laboratory investigations. Also, suitable gas atmospheres were found to be either nitrogen, or neutral or slightly reducing gases, all without moisture or hydrogen.

For the experiments, the crushed ore was ground to pass a 200 mesh sieve and mixed with coke breeze (−35 mesh), limestone and gypsum. The blended ore was sprayed thoroughly with a 23% weight by volume sodium chloride solution and pelletized (see the FIGURE).

Typical conditions for roasting, flotation magnetic separation as well as the amount of reagents used are given below as follows:

| | |
|---|---|
| Pellet size: | 5–20 mm |
| Amount of reagents by weight used: | Limestone 5%, gypsum 0.25%, coke breeze 2.5% and crude sodium chloride 5 to 5.5% |
| Roasting Conditions: | Rate of heating 11 to 12° C/min to the maximum temperature of 950 to 1000° C and a retention time of an hour. |
| The roasted product was ground in a water medium to pass a 100 mesh sieve. Sea water is also suitable. | |
| Conditions of flotation: | pH adjustment to 5.5 – 6.0 activation with copper sulphate (0.2 to 1.0 Kg/t) at 60 to 65° C for 30 minutes, sulphidization with sodium sulphite 0.3 Kg/t and ph adjustment, potassium amyl xanthate addition 1 Kg/t with pine oil 0.1 Kg/t and diesel oil 1 Kg/t as an assisting collector. |
| Conditions for wet magnetic separation: | The ground ore was subjected in the laboratory to a relatively strong magnetic field to obtain a rougher concentrate and a tailing. The former was then submitted to a relatively low magnetic field to obtain a concentrate and a middling. |

RESULTS

Table 1 below shows typical chemical analyses of an ore deposit as well as a coke breeze, respectively.

TABLE 1

| Ore Components | Percent (by weight) on dry basis | Coke Breeze Analysis (Percent by weight) |
|---|---|---|
| Ni | 0.70 | |
| Co | 0.03 | Fixed carbon: 87.45% |
| $SiO_2$ | 47.1 | Volatile matters: 0.65% |
| $Fe_2O_3$ | 32.0 | Ash: 11.90% |
| $Al_2O_3$ | 8.1 | Sulphur: 1.71% |
| CaO | 0.1 | Grain size: −35 mesh |
| MgO | 4.9 | Typical grain size analysis of −35 mesh coke breeze: |
| $Cr_2O_3$ | 1.6 | Mesh Size / Percent |
| L. O. I. (1100° C) | 3.7 | −35 + 48 — 28 |
| | | −48 + 100 — 32 |
| | | −100 + 200 — 20 |
| | | −200 — 20 |
| | | NOTE: The amount of ground −35 mesh size coke breeze should be distributed in such a way that the amount of −100 mesh size should be between 38 to 42%, to assist the reduction process, leaving the remainder of coke particles (from 35 to 100 mesh size) mainly for nickel segregation, thereby improving the nickel grade. |

TABLE 2

Results obtained by a combined process of segregation (under an inert atmosphere of nitrogen) and flotation, according to the already specified conditions with the exception of no gypsum additions.

TABLE 2

| Sample No. | Products | % Wt. | % Ni | Ni - % Recovered | % Co | % $Fe_2O_3$ | % $SiO_2$ | % MgO | % $Cr_2O_3$ | % $Al_2O$ |
|---|---|---|---|---|---|---|---|---|---|---|
| 581 | Conc. | 5.0 | 10.30 | 74.8 | 0.28 | 31.1 | 25.9 | 2.38 | 0.82 | 5.05 |
| 582 | Mid. | 10.3 | 0.29 | 4.3 | — | 32.7 | 45.2 | — | — | — |
| 583 | Tail. | 84.7 | 0.17 | 20.9 | — | 30.7 | 48.6 | — | — | — |
| 606 | Conc. | 5.0 | 9.50 | 75.1 | 0.22 | 31.5 | 26.2 | 2.38 | 1.06 | 5.06 |
| 607 | Mid. | 12.2 | 0.19 | 3.7 | — | 35.5 | 44.8 | — | — | — |
| 608 | Tail. | 82.8 | 0.16 | 21.1 | — | 31.1 | 49.1 | — | — | — |
| 609 | Conc. | 4.8 | 9.60 | 75.3 | 0.21 | 29.1 | 26.0 | 2.42 | 1.03 | 5.39 |
| 610 | Mid. | 13.5 | 0.20 | 4.4 | — | 33.5 | 45.4 | — | — | — |
| 611 | Tail. | 81.7 | 0.15 | 20.3 | — | 31.9 | 46.0 | — | — | — |
| 612 | Conc. | 4.3 | 11.50 | 76.0 | 0.30 | 35.1 | 21.5 | 1.99 | 0.91 | 4.30 |
| 613 | Mid. | 10.3 | 0.19 | 3.0 | — | 33.5 | 46.0 | — | — | — |
| 614 | Tail. | 85.4 | 0.16 | 21.0 | — | 31.9 | 46.4 | — | — | — |

TABLE 3

Comparative results obtained by using different chloridizing agents for segregation through a flotation process under an inert atmosphere and the specified conditions.

| Sample No. | Products | % Wt. | % Ni | Ni - % Recovered | Reagents used for Segregation |
|---|---|---|---|---|---|
| 656 | Conc. | 5.1 | 10.00 | 77.8 | 5% $CaCO_3$, 2.5% Coke |
| 657 | Mid. | 14.3 | 0.23 | 5.0 | 5% NaCl |
| 658 | Tail. | 80.6 | 0.14 | 17.2 | |
| 662 | Conc. | 5.5 | 5.00 | 40.3 | 6.28% $CaCl_2$ $2H_2O$ |
| 663 | Mid. | 16.6 | 0.59 | 14.2 | 2.5% Coke |
| 664 | Tail. | 77.9 | 0.40 | 45.2 | |
| 659 | Conc. | 5.1 | 9.50 | 68.2 | 5% NaCl and |
| 660 | Mid. | 14.0 | 0.28 | 5.5 | 2.5% Coke |
| 661 | Tail. | 80.9 | 0.23 | 26.3 | |

TABLE 4

Comparative results obtained under the above mentioned specified conditions with the additions of calcium sulphate as a promoter.

| Sample No. | Products | % Wt. | % Ni | Ni - % Recovered | Reagents used for Segregation |
|---|---|---|---|---|---|
| 735 | Conc. | 6.1 | 10.15 | 79.4 | 0.25% $CaSO_4$, 5% $CaCO_3$, 5.0% NaCl |
| 736 | Mid. | 10.9 | 0.25 | 3.5 | 2.5% Coke |

-continued

| Sample No. | Products | % Wt. | % Ni | Ni - % Recovered | Reagents used for Segregation |
|---|---|---|---|---|---|
| 737 | Tail. | 83.0 | 0.16 | 17.1 | |
| 754 | Conc. | 6.2 | 7.15 | 66.0 | 1.0% $CaSO_4$, 5% $CaCO_3$, 5.0% NaCl |
| 755 | Mid. | 16.8 | 0.50 | 12.4 | 2.5% Coke |
| 756 | Tail. | 77.0 | 0.19 | 21.6 | |

TABLE 5

Comparative results obtained using different gas atmospheres during the roasting process, maintaining all the remaining factors constant (reagents, temperature, etc.). No gypsum was added.

| Sample No. | Products | % Wt. | % Ni | Ni - % Recovered | Gas Composition |
|---|---|---|---|---|---|
| 669 | Conc. | 3.7 | 13.50 | 74.8 | 80.6% $N_2$ and 19.4% $CO_2$ |
| 670 | Mid. | 9.4 | 0.29 | 4.2 | |
| 671 | Tail. | 86.9 | 0.16 | 21.0 | |
| 718 | Conc. | 4.9 | 10.45 | 75.5 | 79% $N_2$, 17% $CO_2$ and 4% CO |
| 719 | Mid. | 8.1 | 0.33 | 3.9 | |
| 720 | Tail. | 87.0 | 0.16 | 20.6 | |
| 722 | Conc. | 4.9 | 7.55 | 55.5 | 3.7% CO, 16.4% $CO_2$, 75.7% $N_2$ and 4.2% $H_2O$ |
| 723 | Mid. | 6.6 | 0.56 | 5.6 | |
| 724 | Tail. | 88.5 | 0.29 | 38.9 | |
| 729 | Conc. | 4.8 | 6.80 | 46.3 | 14.7% $CO_2$, Air 4.9%, 76.6% $N_2$ and 3.8% $H_2O$ |
| 730 | Mid. | 13.7 | 0.63 | 12.2 | |
| 731 | Tail. | 81.5 | 0.36 | 41.5 | |

TABLE 6

Comparative results obtained with roasted and ground samples shared in equal parts to recover the nickel either by flotation or by wet magnetic separation.

Table 6

| Sample No. | Products | % Wt. | % Ni | Ni - % Recovered | Method used for Ni Recovery | Observations |
|---|---|---|---|---|---|---|
| 776 | Conc. | 5.4 | 9.75 | 75.3 | Flotation | Sample shared with the Group No. 779. The roasting was carried out under a neutral atmosphere and the reagents were the same with sample No. 581 |
| 777 | Mid. | 11.1 | 0.39 | 5.8 | | |
| 778 | Tail. | 83.1 | 0.17 | 18.9 | | |
| 779 | Conc. | 4.6 | 12.15 | 78.0 | Magnetic Separation | |
| 780 | Mid. | 3.6 | 0.40 | 2.0 | | |
| 781 | Tail. | 91.2 | 0.15 | 20.0 | | |

DISCUSSION OF THE RESULTS

The results obtained by the devised combined process of segregation (under inert, neutral or slightly reducing atmospheres) through the flotation or magnetic separation have proved satisfactory as far as the grade and the nickel recovery are concerned.

The effect of the porosity is shown by the result obtained by sample No. 662 in Table 3 where calcium chloride was used as a chloridizing agent. It was observed (after cooling) that the roasted product with calcium chloride was harder and less porous than the corresponding roasted ore, with the above mentioned devised chloridizing mixture under the same roasting conditions, e.g. heating rate, retention time, gas flow rate, etc., at least for the type of ore examined. The same phenomenon was observed with sodium chloride when it was used alone, but to a lesser extent than calcium chloride. Again, the grade and the nickel recovery were lower (sample No. 659 in Table 3), but better than in the case of calcium chloride.

Apart from the porosity effect in the segregation process already mentioned, there is also the problem of choosing a proper chloridizing agent with regard to the ores containing combined water. Although $CaCl_2$ is considered as the best chloridizing agent for the nickel segregation (this is valid only in the presence of very small amounts of water) it has the disadvantage that it cannot be successfully used for nickel ores containing combined water (as has been concluded from the experiments). In an attempt to remove the combined water by preroasting the sample at a temperature around 900° C, no satisfactory results were obtained for the segregation, apparently due to the new mineralogical components formed during the ore preroasting, particularly the forsterite, which presumably includes in its lattice some nickel oxide.

However, the combined water is of importance for non-preroasted ores, at the temperature of their decomposition, since the water would react with a chloridizing agent in the presence of silicates to form HCl. More HCl would be formed by the action of $CaCl_2$ than by NaCl. Consequently, a greater part of HCl would would be lost (together with water) in the case of $CaCl_2$ use, without reacting with nickel oxide or iron oxide to form the corresponding chlorides.

This is a reasonable explanation for the unsatisfactory results obtained when $CaCl_2$ was used alone. In the present approach, apart from the use of NaCl as a chloridizing agent, calcium carbonate was chosen to fulfill a double function: firstly, in maintaining an adequate porosity during the ore roasting; and secondly, to store a potential amount of chloride as calcium chloride which is formed by the reaction of $CaCO_3$ with HCl. Thus $CaCl_2$ would be able to react more favorably at higher temperatures (in the presence of a minimum amount of water) for nickel chloridization.

The relatively better results obtained with sodium chloride alone, by comparing them with $CaCl_2$ used, are due to the fact that the former is a weaker chloridizing agent, than the latter. Specifically, during the releasing of combined water, a comparatively less portion of chloride from NaCl is consumed for HCl formation, leaving the remainder for the chloridization of nickel in the presence of a minimum amount of water at higher temperatures.

The beneficial effect of calcium sulphate is shown by sample No. 735 in Tble 4 by comparing the results obtained in the absence of it (Table 2). In contrast, increasing amounts of calcium sulphate have an adverse effect on segregation (sample No. 754, Table 4). In the light of the above observations, it was concluded that calcium sulphate in small amounts acts as a promoter, apparently in the chloridization of nickel and iron during the segregation process. Larger amounts would favor the reduction of nickel oxide "in situ" and not through the nickel chloride.

The ambient atmosphere plays an important role in the segregation process. Thus, roastings carried out under an oxidizing or even reducing atmosphere with moisture as shown in Table 5 for samples Nos. 729 and 722 respectively, are unfavorable for this process. The above findings are in full agreement with the predictions in the mechanism of the process and the nickel segregation must be carried out under an indirect heating. There are slight differences between the results obtained for nickel recovery in the roasted product through either flotation or magnetic separation as shown in Table 6. However, it is expected to obtain even better results as far as the grade and the nickel recovery are concerned by using various and more selective magnetic field intensities based always on the same principle as set forth in the present process.

CONCLUSIONS

The nickel segregation is an outstanding example of a process in which the ambient atmosphere strongly affects it. Therefore, the process must be carried out under an indirect heating. According to recent developments, such types of heating kilns seem to be available in an industrial scale, capable to work up to a temperature of 1000° C.

The roasting-flotation process makes it possible to treat the concentrate by a hydrometallurigical treatment in view of its easy dissolution in acid or leaching with ammonia. It present also the advantage that the concentrate has a relatively low ratio value of iron to nickel which is approximately 2.2:1 as well as the advantage of low cost of energy, compared with a smelting process. The concentrate obtained by the roast-flotation process should be treated hydrometallurgically in view of the removal of copper from nickel.

On the other hand, the concentrate obtained from the roasting-magnetic separation due to its relatively high ratio value of iron to nickel which is approximately 4.2:1 may be treated by a smelting process to obtain a high grade iron-nickel alloy.

Generally, the present process is an economical one, because of its low cost of reagents used for the segregation and particularly when it is combined with a magnetic separation. Moreover, the weight of the concentrate is only approximately 5% of the initial weight.

Obviously, many modifications and variations of the present invention are possible in the light of the above teachings. It is therefore to be understood that within the scope of the appended claims the invention may be practiced otherwise than as specifically described.

What is claimed is:

1. A process of upgrading nickel from nickel lateritic iron ore having an iron content by weight of over 10%, silica of over 25% and a nickel content of at least 0.5%, comprising, grinding the ore, thoroughly mixing the ground ore with calcium carbonate, calcium sulphate and coke, spraying the mixed ore with a solution of sodium chloride and making pellets therefrom, drying the pellets, heating at a temperature not greater than 1050° C for up to 90 minutes, roasting at the above temperature for a predetermined period of time so as to convert all the nickel from the ore to a metalic condition in a neutral or a slightly reducing atmosphere, grinding the roasted pellets in a water medium, and adjusting the density of the pulp resulting from grinding for a subsequent process to obtain a concentrate by one of a flotation and a magnetic separation treatment so as to thereby obtain a rich nickel concentrate.

2. The process according to claim 1, wherein the iron ore is obtained by blending different nickel bearing ores, such as laterities and nickel serpentines, so as to achieve a mixture having the percentages of Fe over 10%, $SiO_2$ over 25% and Ni at least 0.5%.

3. The process according to claim 1, wherein two stages of mixing are carried out before making the pellets: thoroughly mixing the ground ore with limestone, gypsum and coke, and continuing the mixing and spraying it with three-fourths the total amount of the sodium chloride solution, and leaving the remainder of the solution for the pelletizing stage, whereby improved nickel recoveries are achieved.

4. The process according to claim 1, wherein the water medium includes soft water or sea water.

5. The process according to claim 1 further including the use of diesel oil as an assisting collector in the flotation of the nickel which may be segregated on a carbon surface of coal and eventually on the gangue ore thereby resulting for better nickel recoveries.

6. The process according to claim 1, wherein the ground roasted product is submitted to a wet or a dry magnetic separation in order to obtain a concentrate of high grade nickel.

7. A process of upgrading nickel from nickel lateritic iron ore having an iron content by weight of over 10%, silica of over 25% and a nickel content of at least 0.5%, comprising, grinding the ore, thoroughly mixing the ground ore with sodium chloride gypsum and coke breeze, heating the mixed ore at a temperature not greater than 1050° C for up to 90 minutes, roasting at the above temperature for a predetermined period of time so as to convert all the nickel from the ore to a metallic condition in a neutral or a slightly reducing atmosphere, grinding the roasted mixture in a water medium, and adjusting the density of the pulp resulting from the grinding for a subsequent process to obtain a concentrate by one of a flotation and a magnetic separation treatment so as to thereby obtain a rich nickel concentrate.

8. The process according to claim 7, wherein 38 to 42% of the coke breeze has a grain size of minus 100 mesh, with the grain size of the remainder of the coke breeze being of 35 to 100 mesh to thereby improve the grade of nickel concentrate.

9. The process according to claim 7, wherein the amount, by weight, of sodium chloride varies between 1.5 and 7.5%, that of gypsum from 0.1 to 0.5%, that of coke breeze from 2 to 5% and finally that of limestone from 0 to 10%.

* * * * *